United States Patent [19]

Meyers

[11] 4,364,504

[45] Dec. 21, 1982

[54] FEEDING DEVICE

[75] Inventor: George Meyers, Ashland, Ohio

[73] Assignee: The Garber Company, Ashland, Ohio

[21] Appl. No.: 193,539

[22] Filed: Oct. 3, 1980

[51] Int. Cl.[3] ..... B65H 17/38

[52] U.S. Cl. ..... 226/76; 226/87; 226/190; 226/199

[58] Field of Search ..... 226/76, 77, 80, 82, 226/83, 86, 87, 27, 28, 23, 6, 53, 52, 190, 196, 199

[56] References Cited

U.S. PATENT DOCUMENTS

| | | | |
|---|---|---|---|
| 1,623,814 | 4/1927 | Scott | 226/76 |
| 1,896,542 | 2/1933 | Evans | 226/87 |
| 1,915,533 | 6/1933 | Johnson | 226/87 X |
| 2,275,064 | 3/1942 | Moore | 226/6 |
| 2,583,086 | 1/1952 | Carpenter | 226/76 |
| 2,620,205 | 12/1952 | Vogt | 226/76 X |
| 2,724,939 | 11/1955 | Vogt | 226/28 X |
| 3,033,445 | 5/1962 | Dreyer | 226/76 X |
| 3,747,820 | 7/1973 | Hawxhurst | 226/76 |
| 3,941,289 | 3/1976 | Jenkins | 226/76 |
| 4,197,799 | 4/1980 | Sato | 226/53 X |

*Primary Examiner*—Stanley N. Gilreath

*Attorney, Agent, or Firm*—Yount & Tarolli

[57] ABSTRACT

An apparatus advances and registers web material relative to a cutting mechanism. The cutting mechanism cuts the web material transverse to the direction of material advance. The apparatus comprises a guide for guiding the web material to the cutting mechanism. A rotating cylinder is spaced from the cutting mechanism and adjacent the guide. Projecting elements are carried on the rotating cylinder and spaced circumferentially on the rotating cylinder a distance substantially equal to the distance between cut lines in the web material. The projecting elements have a surface portion which engages at least a portion of the web material adjacent the cut line and forces a portion of the web material out of the plane of the web material. The projecting elements further have a surface portion for engaging the web material and pushing the web material through the guide and to the cutting mechanism.

3 Claims, 11 Drawing Figures

FEEDING DEVICE

BACKGROUND AND SUMMARY OF THE INVENTION

The present invention relates to a mechanism for handling web material and particularly to a mechanism for feeding web material in a registered condition to a cutting mechanism.

Specifically, the present invention relates to the feeding of web material having individual images formed or printed thereon. The web material specifically may be a board like material which forms a structural part of a package, for example, the bottom board of a package. Bottom boards are used for supporting cakes or other edible products in a package, as is well known.

Typically such material is cut into individual pieces and fed from the cutting apparatus into a packaging machine. In the packaging machine a cake, pie or the like is deposited on the board material, and the board and the cake or pie is wrapped. Of course, the present invention is equally applicable to the cutting of any material, whether it be a bottom board or not.

The material, such as a bottom board for a package, frequently has a series of images printed thereon. Of course, it is necessary to register the material to the cutting mechanism so that the material is properly cut in a manner to insure that each image will be properly located in the package. Heretofore, registry of the printed image on the web material to the cutting apparatus has been effected in a number of ways. One common type of mechanism to effect such registry involves a photoelectric eye which senses a register mark on the web material and controls feed rollers to either speed up or slow down the advancing movement of the web relative to the cutting mechanism to thereby register the material to the cutting mechanism. Such a registry mechanism has not been entirely satisfactory due to the space relationship between the photoelectric eye and the feed rollers which drives the web material and also due to the difficulties and problems of driving the rolls at variable speeds. The photoelectrically controlled mechanism has not resulted in precise registry of the material to the cutting mechanism.

The present invention provides for very precise registry of the material to the cutting mechanism. According to the present invention the material being fed is provided with a series of successive cut lines therein. The cut lines are formed in the material in registry with the printed image on the web material and specifically are formed in or adjacent to the printing apparatus which prints on the web material. Accordingly, registry of the cut line to the printed image on the material is precise.

In accordance with the present invention, each cut line defines an area of the material which may be deflected out of the plane of the material as the material is advanced toward the cutting mechanism. The material is advanced toward the cutting mechanism under the control of a rotating cylinder which has a plurality of projections spaced therearound. The projections are spaced around the cylinder a distance equal to the distance between the cut lines. One surface portion of each of the projections engages the material and deflects the material out of the plane of the web material. The projections have another surface portion which engages an edge of the material defined by the cut line to force the material forwardly toward the cutting mechanism.

In accordance with the present invention, if the web material is out of registry or is not in a position where a projection can deflect the area defined by a cut line and engage the edge of the material, the rotating cylinder and the projection attached to it will move relative to the web material until an area defined by a cut line is adjacent the projection. Then the projection will deflect the material out of the plane of the paper. In accordance with the present invention, once the projection is located to advance the material upon rotation of the projection, the web material is advanced under the total control of the projection and the rotating cylinder which supports the projection, i.e., the projections, once they have engaged a cut portion of the material, push the material through a guide to the cutting mechanism.

For purposes of cutting off different lengths of the web material for different packaging requirements, different rotating cylinders may selectively be positioned in the mechanism. The different rotating cylinders carry projections which are spaced different distances apart in order to correspond with the different distances between cut lines formed in the web material. Also the guide which guides the web material to the cutting mechanism is constructed so as to be adjustable in order to receive web material from any of the rotating cylinders which may be of different size. In fact, the mechanism is constructed so that different diameter rotating cylinders may be supported in the mechanism simultaneously and slid into position selectively depending upon the distance between the cut lines in the material being handled by the mechanism.

DETAILED DESCRIPTION OF THE DRAWINGS

Further features and advantages of the invention will be apparent to those skilled in the art to which the present invention relates from a consideration of the detailed description of the present invention made with reference to the accompanying drawings in which.

DETAILED DESCRIPTION OF PREFERRED EMBODIMENT

As discussed above, the present invention relates to an apparatus for handling web material, and specifically it relates to an apparatus for feeding web material having individual images successively formed thereon to a cutting apparatus. The cutting apparatus cuts the web material transverse to its path of movement to form individual pieces from the web material. The apparatus is particularly useful in packaging. Particularly, the apparatus is useful for the handling of web material which is of rather heavy stock and is in the nature of a cardboard. The board may be used as a structural part of a package such as the bottom board or a support for articles placed in a package. After the board material is cut it is advanced into a packaging machine.

Figure 1:
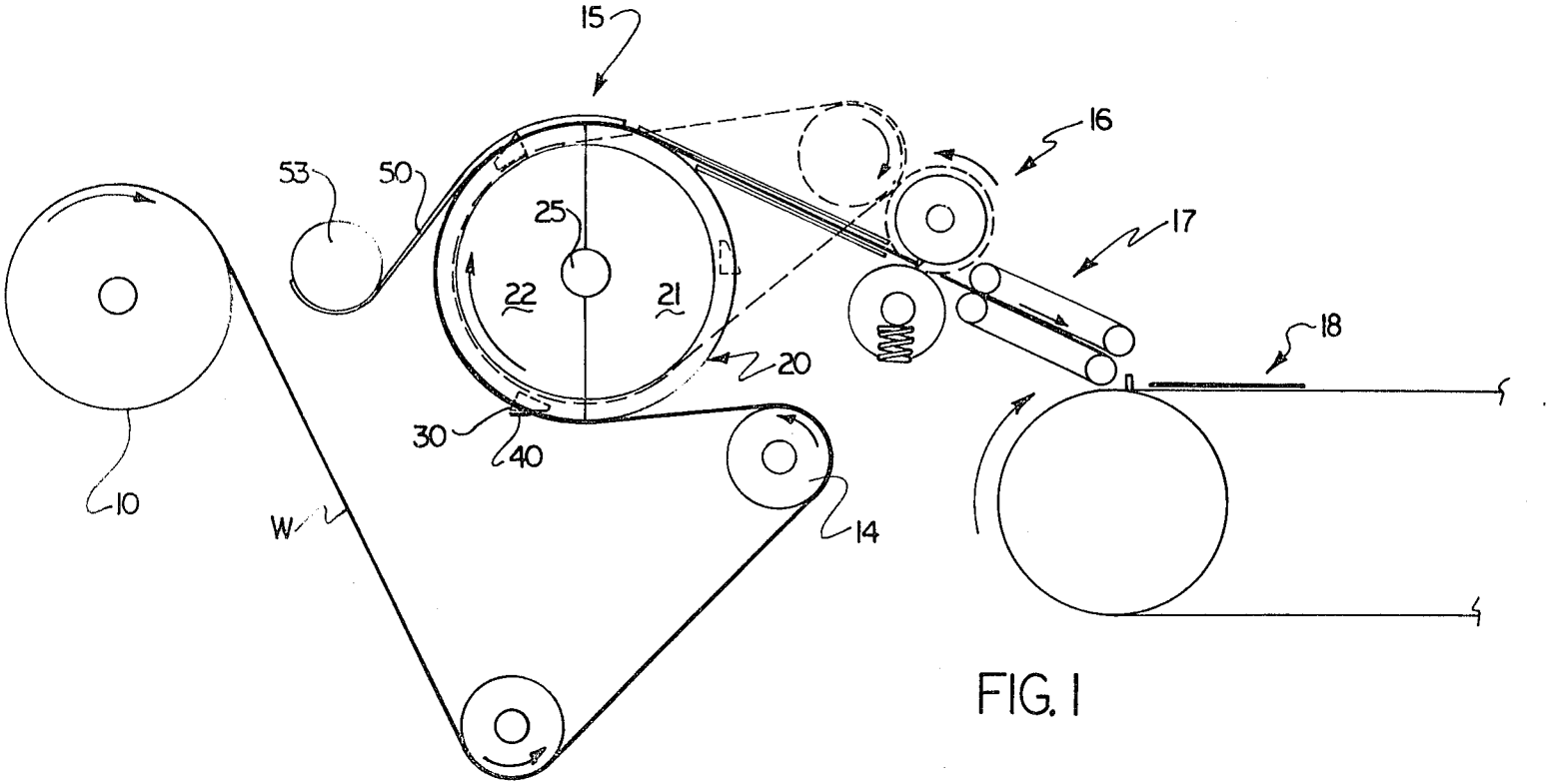
FIG. 1 is a schematic illustration of a system embodying the present invention.

FIG. 1 illustrates schematically the present invention embodied in a machine for forming bottom boards for packages for cakes or pies. As shown in FIG. 1, a web W is provided on a reel 10. The web material W is advanced from the reel 10 through a series of guide rolls, one of which is designated 14. The guide roll 14 directs the web material to a register mechanism 15 embodying the invention. The register mechanism 15 functions to register the web material relative to a cutting mechanism 16 and advance the web material to the cutting mechanism 16. The cutting mechanism 16 cuts the web material transverse to its direction of advance into individual pieces. The cutting mechanism comprises a rotating knife which cooperates with a spring biased anvil in the form of a roll. After the web material is cut, it is fed by a mechanism 17 into a position to be conveyed by a flight conveyor 18 into a packaging machine, not shown.

Figure 2:
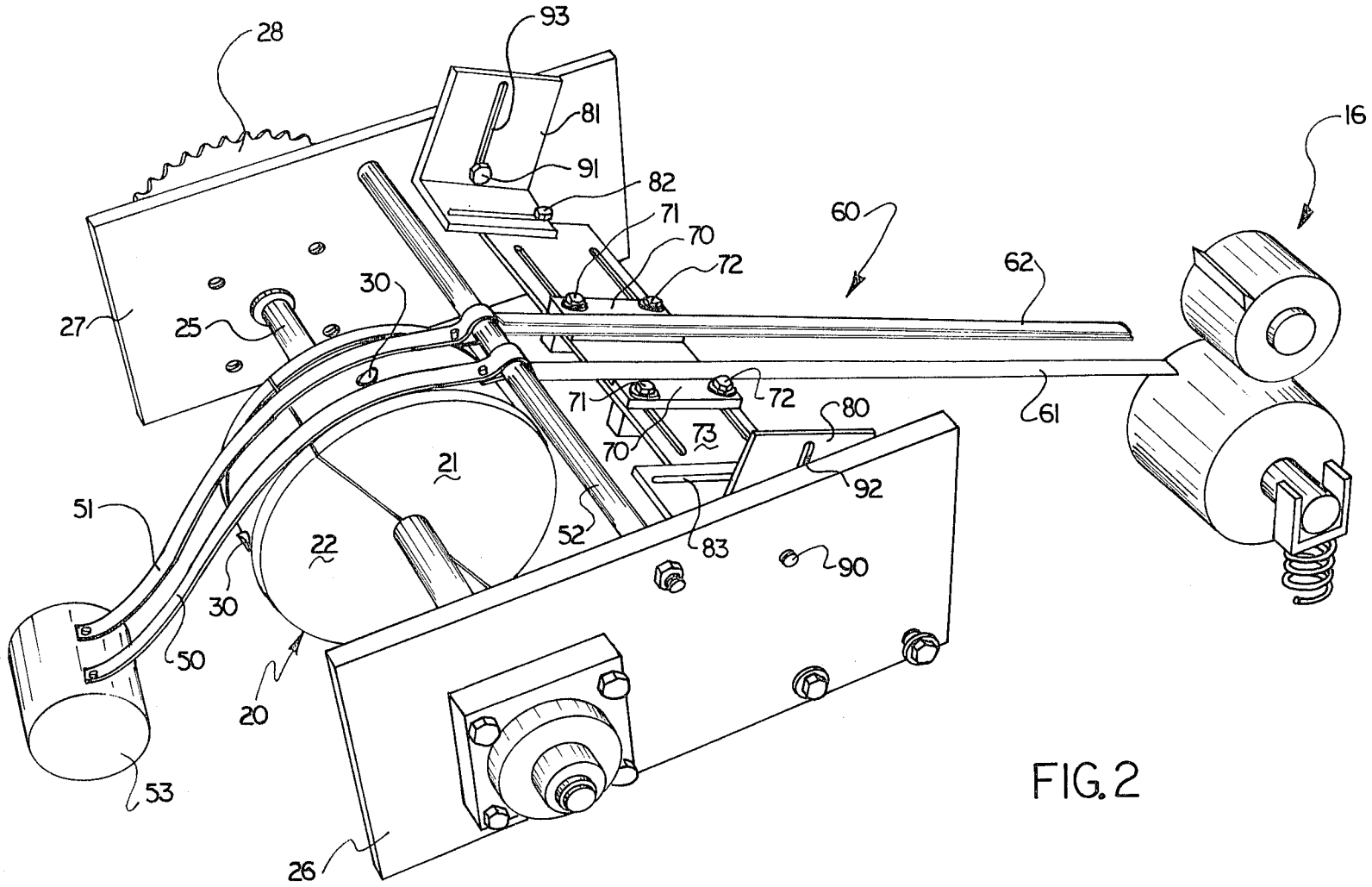
FIG. 2 is a perspective view illustrating a part of the system of FIG. 1 embodying the present invention.
Figure 3:
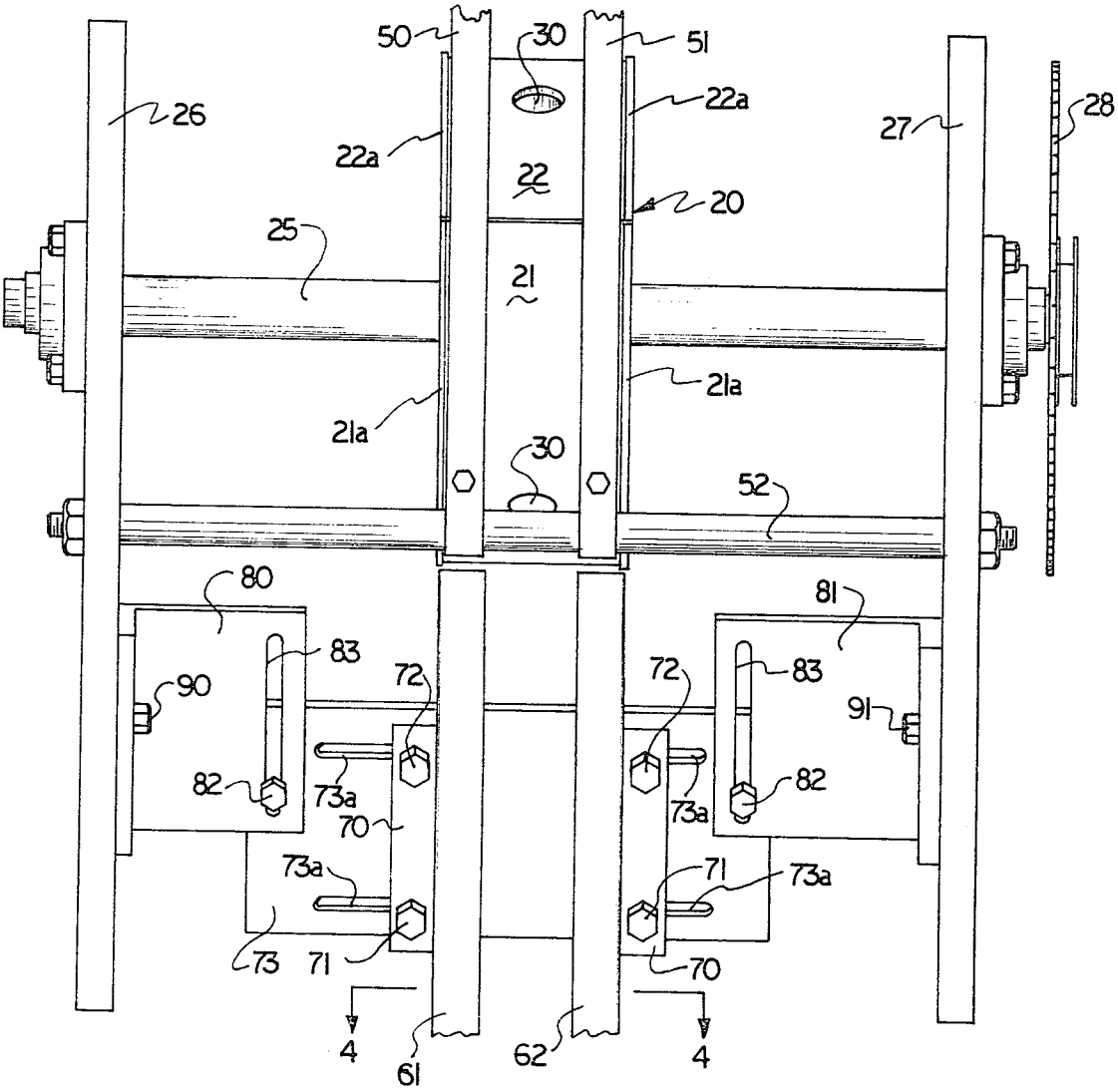
FIG. 3 is a top view of the mechanism of FIG. 2.
Figure 6:
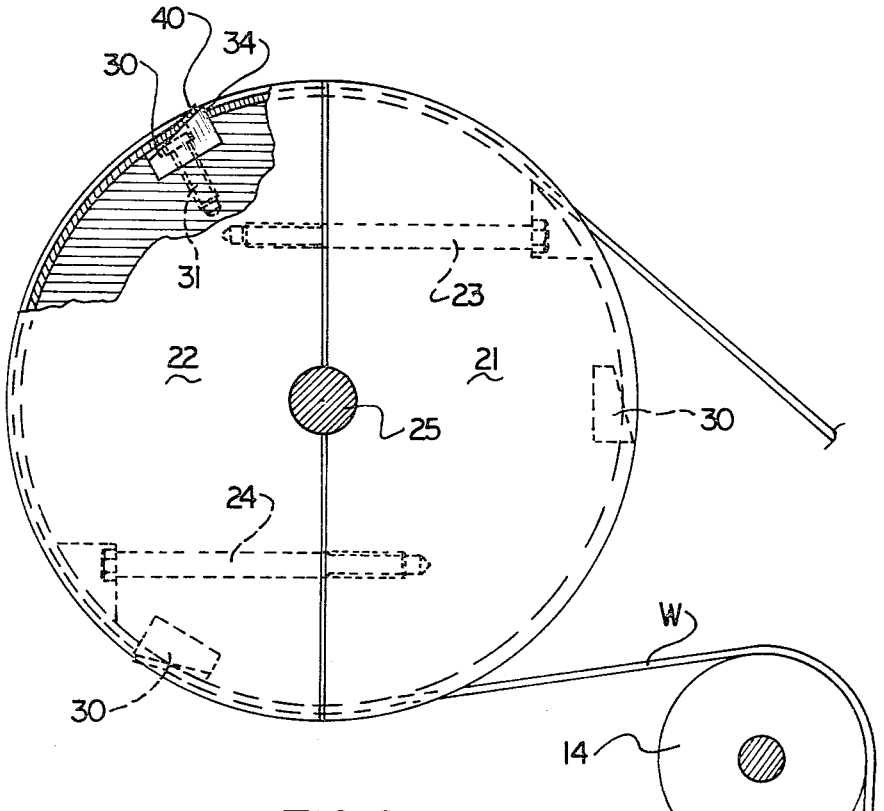
FIG. 6 is an enlarged view of a portion of the system of FIG. 1.

The present invention involves the mechanism 15 which feeds the web material to the cutting mechanism and registers the web material to the cutting mechanism 16. The mechanism 15 includes a drum 20 (FIG. 6). The drum 20 is formed in two halves designated 21 and 22 which are clamped together by fasteners 23 and 24. Each of the drum halves 21, 22 has opposite lateral projecting rims 21*a*, 22*a*, respectively (see FIG. 3). The fasteners 23 and 24 clamp the drum 20 onto a shaft 25. The shaft 25 is supported for rotation by side frame members 26 and 27 (FIG. 2). A sprocket 28 is supported on the shaft 25. A chain is trained around the sprocket 28 in a suitable manner in order to effect rotation of the shaft 25 and therefore rotation of the drum 20.

Figure 7:
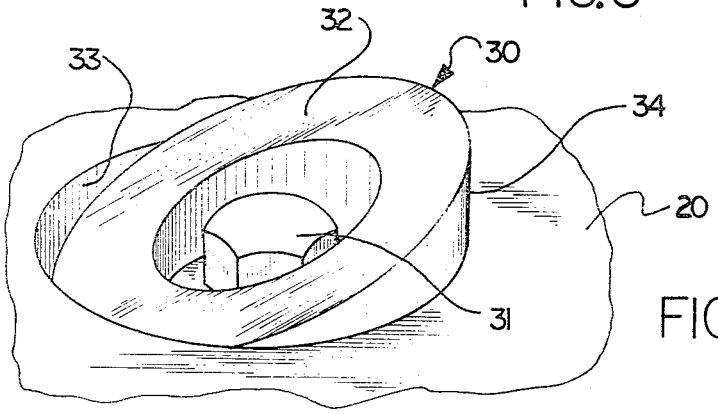
FIG. 7 is a view of a part of FIG. 6.

The drum 20 has spaced around its circumference a plurality of projections each of which is designated 30. As shown in the drawings three projections are spaced equally around the drum. The projections 30 are cylindrical wedge-shaped members and are secured to the drum 20 by fasteners 31 (FIG. 7). The projections 30 are located in recesses 33 in the outer periphery of the drum 20. It should be obvious that the projections rotate with the drum 20 upon rotation thereof.

A portion or upper surface 32 of each projection 30 extends beyond the periphery of the drum 20 while other portions of the surface 32 are located inwardly of the periphery of the drum 20. In plan view the projections 30 are cylindrical, as best shown in FIG. 7 and the upper surfaces 32 are oval, lieing in a plane transverse to the axis of the projections and inclined relative thereto.

Figure 5:
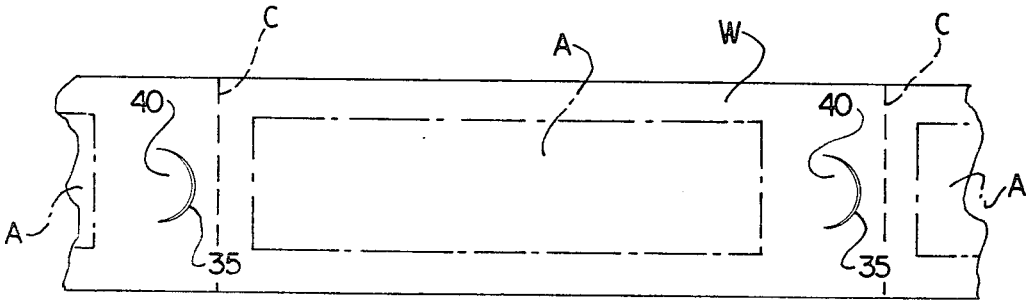
FIG. 5 is a view of a portion of the web material which is handled by the mechanism embodying the present invention.

A portion of the web material W is shown in FIG. 5. The web material includes spaced image areas A which are printed on the web material. Also, at spaced locations along the web material W there are cut lines designated 35. The cut lines are at equally spaced intervals along the web material. Each cut line 35 in the present embodiment is semicircular in shape and defines an area designated 40.

As best shown in FIG. 1, as the web material is advanced, it moves around the roll 14 and is guided into position adjacent the periphery of the drum 20. The material is advanced as shown in FIG. 1 so that it wraps around the drum 20 for more than 180°. As the material W approaches the drum 20, the projections 30 which are on the drum 20 engage and deflect the area 40 of the web material out of the plane of the web material. The upper surface portion 32 of a projection 30 engages the undersurface of the web material and forces the area 40 to deflect out of the plane of the web material. The forward face of the projection designated 34 engages the trailing edge of the area 40 of the material defined by a cut line and pushes the material upon movement of the drum. The fact that the surfaces 34 are circular in plan view as are cut lines 35 results in the projections also functioning to cam the web material laterally to properly center it on the drum 20.

The apparatus 15 also includes a mechanism for retaining and holding the web material W around the drum as the material is advanced by the projections 30. Specifically, the mechanism for holding the material on the drum comprises a pair of guide arms 50 and 51 (see FIG. 2). The guide arms 50 and 51 are attached at one end to a support rod 52. The opposite end of the guide arms carry a weight 53 which biases the guide arms downwardly against the upper periphery of the drum 20. As best seen in FIG. 2, the guide arms are curved in cross section adjacent the support rod 52 and specifically are curved to generally the configuration of the portion of the drum 20 so that the guide arms force and guide the material as it is being advanced by the projections carried on the drum 20. The guide arms are spaced apart so as to enable the projections to advance therebetween and it should be clear, of course, that the guide arms engage the web material W adjacent the lateral edges thereof.

As shown in FIG. 1, the material W is wrapped around the drum 20 to an extent that normally two projections 30 are engaged in the web material and are pushing the web material around and away from the drum 20 toward the cutting mechanism.

Figure 8A:
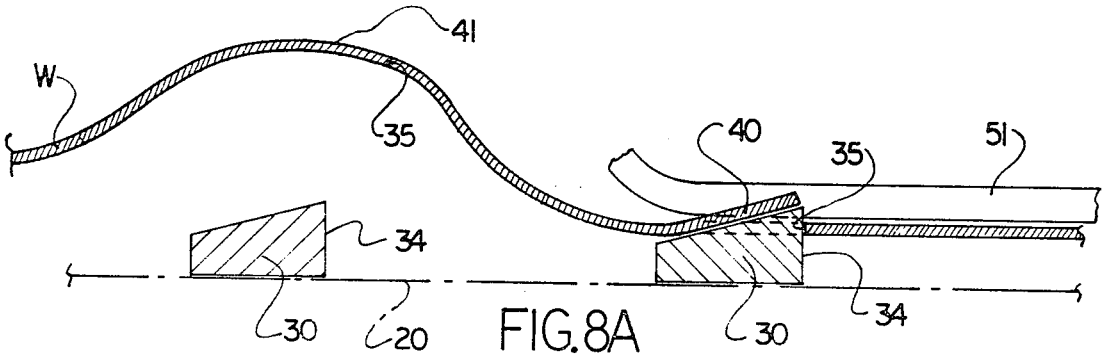
FIGS. 8A, 8B and 8C are schematic figures illustrating the operation of the present invention.
Figure 8B:
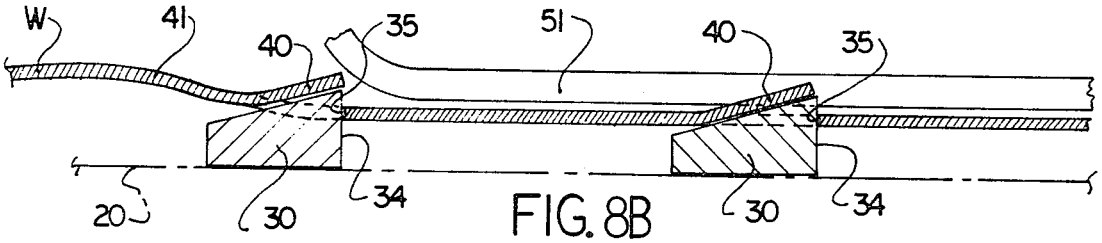
Figure 8C:
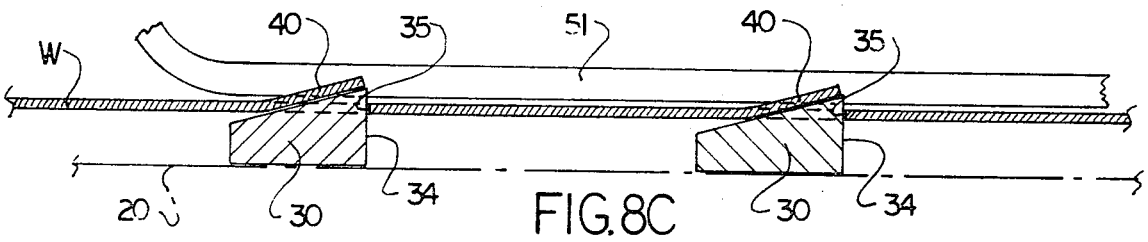

In the event that the web material W is out of registry with the projections 30, the projections 30 will move relative to the web material and deflect the area 40 when the area 40 comes in adjacent relation with projection 30. The projections operate to secure accurate registry of the web material when the web is out of registration in the direction of feed. FIGS. 8A-8C illustrate schematically the operation of the apparatus 15 in the event that the web material W becomes slack, as by being fed from the supply 10 at too great a speed. In this event a bulge of excess web material 41 would be formed. The leading projection 30 (on the right in FIG. 8A) advances until its upper surface 32 forces an area 40 of the web upward out of the plane of the web and its leading edge 34 engages the edge of the web around the cut 35. The guides 50 and 51 force the web material down on either side of the projection 30 to assist in this operation. As the loop 41 of excess web material approaches the guide 51, it is forced downward toward the periphery of the cylinder 20 as the trailing projection 30 (on the left in FIG. 8B) forces the area 40 upward and its leading edge 34 engages the edge of the cut 35.

The projection 30 also serves to assure accurate lateral registration of the web. The cut line 35 is semi-circular and of a slightly larger radius than the projection 30. In the event that the web is slightly out of lateral alignment, the center of curvature of the cut line will not be coaxial with the projection 30 but instead will be displaced to one side. In this case the projection 30 will force the area 40 of the web upward, and the curved leading edge 34 of the projection 30 will engage the curved surface of the cut in the web. As the cylinder 20 rotates and force is transmitted through the projection 30, lateral displacement of the web will naturally occur because of the contact of the curved front 34 of the projection with the arcuate surface of the cut line.

Accordingly, it should be clear that the projections 30 which are spaced around the circumference of the drum 20 and a distance equal to the distance between the cut lines 35 effect a positive engagement of the web material and force the web material towards the cutting mechanism 16 in a positive and controlled manner.

Figure 4:
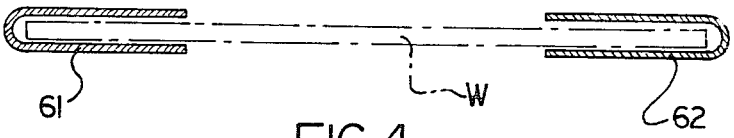
FIG. 4 is a cross sectional view of a portion of the mechanism of FIG. 3 taken approximately along the line 4—4 of FIG. 3.

The apparatus 15 also includes a mechanism designated 60 for guiding the web material from the drum 20 to the cut off mechanism 16. The guides 60 comprise a pair of opposite lateral guides 61 and 62 which are U-shaped in cross section. The web material is advanced or pushed into the guides 61 and 62 by the projections 30 rotating with the drum 20. The opposite lateral edges of the web material are received in the guides 61 and 62 as best shown in FIG. 4. These guides guide the material into the cutting nip defined by the cutting mechanism 16.

The mechanism 15 is constructed so that it may be adjusted for the handling of different web materials, and specifically web materials having different distances between cut line 35 on the web material. When the distance between cut lines 35 on the web material changes, the circumferential distance between the projections 30 on the drum 20 must also change. In order to effect this change, the fasteners 23 and 24 which clamp the drum 20 on the shaft 25 may be loosened and a new drum positioned on the shaft 25. It is also possible to mount plural drums on the shaft 25 which are of different size and those plural drums can be slid along the shaft when the fasteners 23 and 24 are loosened in order to position a particular drum in operating position on the shaft.

During set up, the line C at which the material is cut by cutting mechanism 16 is aligned with the knife of the cutting mechanism. The web material W may then be positioned so that projections 30 engage in the areas 40. This can be accomplished by rotating the drum 20 relative to shaft 25 and the web W until alignment occurs. After set up, the apparatus 15 will ensure registry of the cutting mechanism 16.

Also, the guide 60 for guiding the web material from the drum 20 to the cutting mechanism 16 is adjustable in order to properly cooperate in a tangential manner with the drum 20 depending upon the size of the drum.

Each of the guides 61 and 62 is supported on a guide plate 70 by a pair of fasteners 71 and 72. The fasteners are mounted in slots 73*a* in a support plate 73 and the guides 61 and 62 may be adjusted laterally by loosening the fasteners 71 and 72 and moving the fasteners in the slots 73*a* in which they are received. In this way it is possible to adjust for webs of different widths.

The opposite ends of the support plate 73 are secured to brackets 80 and 81, respectively. Fasteners 82 secure the support plate 73 to the brackets 80 and 81. The fasteners 82 extend through slots 83 in the respective brackets 80 and 81. By loosening the fasteners 82, the plate 70 may be moved toward and away from the periphery of the drum 20. In addition, the brackets 80 and 81 are pivotally attached to side frames 26 and 27, respectively. Specifically the brackets are pivotally attached to the side frames by fasteners 90 and 91, respectively which extend through slots 92 and 93, respectively, in the brackets 80 and 81. By loosening the fasteners 90 and 91 the brackets 80 and 81 may be adjusted vertically and also pivoted in order to adjust the relationship between the end of the guides 61 and 62 and the drum 20. The adjustments provided by fasteners 82, slots 83, fasteners 90 and 91 and slots 92 and 93 provide for a smooth and tangential feeding of the web material W into the guides 61 and 62.

When the cylinder 20 is exchanged for a cylinder of a different diameter, no alteration need be made in the gearing between the cutting mechanism 16 and the cylinder 20. Because in the disclosed embodiment each of the cylinders 20 has three projections 30 on it and the cutting mechanism 16 has only one cutting knife, the cutter wheel with the knife mounted thereon must rotate at three times the speed of the cylinder 20. This relationship is not affected by changing the diameter of the cylinder 20.

Figure 9:
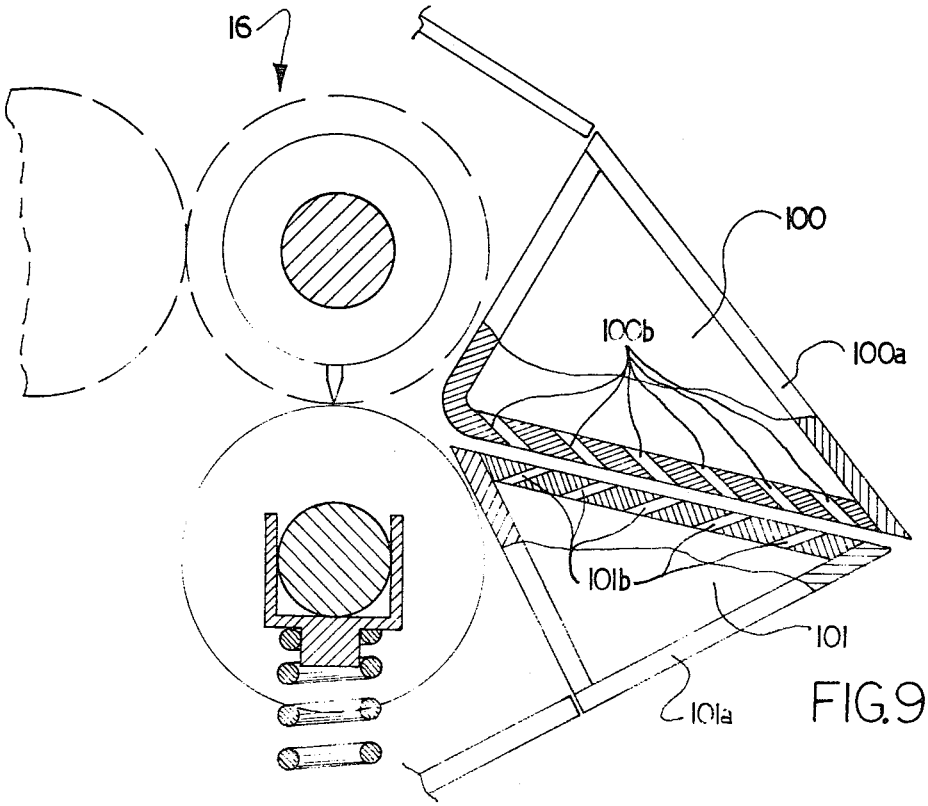
FIG. 9 is a view of a modified embodiment of the present invention.

A modified embodiment of the present invention is disclosed in FIG. 9. In this embodiment, instead of feeding the cut pieces by a conveyor mechanism 17, the cut pieces are advanced by air pressure. Specifically, air pressure chambers 100, 101 are located adjacent the cutting nip. These chambers 100, 101 are formed from triangular shaped housings (as shown in FIG. 9) 100*a*, 101*a*, respectively. Each chamber 100, 101 has openings 100*b*, 101*b* which direct air pressure at an angle and forwardly against the cut pieces of web material. Specifically, these openings are directed in the direction that the web material pieces are moved toward the packaging machine.

From the above, it should be clear that applicant has provided a substantially new and improved mechanism for feeding web material to a cutting mechanism and which insures that the web material will be fed to the cutting mechanism in a registered relationship with the cutting mechanism.

What is claimed is:

1. Apparatus for handling web material having individual images successively formed thereon and successive cut lines therein which cut lines are curved transverse to the direction of movement of the web material, said apparatus advancing and registering web material relative to a cutting mechanism which cuts the web material transverse to the advancing direction, said apparatus comprising a guide for guiding said web material to said cutting mechanism, a rotating drum spaced from said cutting mechanism and adjacent said guide, projecting elements on said rotating drum and spaced circumferentially on said rotating drum a distance substantially equal to the distance between said cut lines, said projecting elements having a surface portion extending chordally relative to said drum and beyond the periphery of said drum for engaging at least a portion of said web material adjacent said cut line and forcing at least a portion of said web material out of the plane of said web material and for projecting through said plane of said web material, said projecting elements having a further curved surface portion extending transverse to the direction of movement of the web material for engaging the edge of said web material at said cut line and advancing the web material through said guide and to said cutting apparatus, said drum being formed of plural arcuate segments having a predetermined circumference, a drive shaft on which said segments are mounted, means for securing said segments together and for removably clamping said segments on said drive shaft for rotation therewith and for removal therefrom for replacement by other segments of a different circumference when the distance between the cut lines in the web material changes, said guide for guiding the web material to the cutting mechanism comprises a pair of U-shaped lateral guide members, and means for supporting the guide members for adjustment relative to the periphery of said rotating drum to adjust the tangential relationship between the guide members and said drum when there is a change in the segments forming said drum.

2. Apparatus as defined in claim 1 further including means for guiding the web material around said drum and for holding the web material against the drum, said means for holding the web material against the drum comprising a pair of arms partially encircling said drum and laterally spaced to enable said projections to advance therebetween, and means biasing said arms against the periphery of the drum.

3. Apparatus for handling web material as defined in claim 1 further including means for guiding said web material around more than 180° of said drum.

* * * * *